US009223271B2

(12) United States Patent
Noren et al.

(10) Patent No.: US 9,223,271 B2
(45) Date of Patent: Dec. 29, 2015

(54) DETERMINING HIGH TONER USAGE

(71) Applicant: XEROX CORPORATION, Norwalk, CT (US)

(72) Inventors: Andrew Stephen Noren, Hemel Hempstead (GB); David Gray, Welwyn Garden (GB); Simon Gray, Westoning (GB); Keith Morgan, St. Albans (GB)

(73) Assignee: Xerox Corporation, Norwalk, CT (US)

( * ) Notice: Subject to any disclaimer, the term of this patent is extended or adjusted under 35 U.S.C. 154(b) by 117 days.

(21) Appl. No.: 14/134,824

(22) Filed: Dec. 19, 2013

(65) Prior Publication Data

US 2015/0177660 A1 Jun. 25, 2015

(51) Int. Cl.
*G03G 15/00* (2006.01)

(52) U.S. Cl.
CPC ..... *G03G 15/50* (2013.01)

(58) Field of Classification Search
CPC combination set(s) only.
See application file for complete search history.

(56) References Cited

U.S. PATENT DOCUMENTS

| | | | | |
|---|---|---|---|---|
| 5,204,698 | A | 4/1993 | LeSueur et al. | |
| 5,204,699 | A | 4/1993 | Birnbaum et al. | |
| 5,349,377 | A | 9/1994 | Gilliland et al. | |
| 5,802,420 | A | 9/1998 | Garr et al. | |
| 5,946,450 | A | 8/1999 | Ebner et al. | |
| 6,810,218 | B1 | 10/2004 | Wong et al. | |
| 7,444,088 | B2 | 10/2008 | Radulski et al. | |
| 7,761,015 | B2 | 7/2010 | Wong | |
| 7,801,453 | B2 | 9/2010 | Golding et al. | |
| 7,804,629 | B2 | 9/2010 | Jacobs et al. | |
| 7,983,574 | B2 | 7/2011 | Kolb | |
| 2003/0228157 | A1* | 12/2003 | Byun et al. | 399/12 |
| 2012/0148267 | A1* | 6/2012 | Kawai | 399/8 |
| 2013/0071130 | A1 | 3/2013 | Hayashi et al. | |

* cited by examiner

*Primary Examiner* — Clayton E Laballe
*Assistant Examiner* — Jas Sanghera
(74) *Attorney, Agent, or Firm* — Gibb & Riley, LLC

(57) ABSTRACT

According to a method herein, a number of pixels marked and times of printing are automatically determined for a plurality of images. A time-based moving window of pixel counts for a subset of the plurality of images being contiguously processed in a current time window is automatically calculated, based on the number of pixels marked and the times of printing of the subset of the plurality of images processed in the current time window. Marking material usage to print the plurality of images for the current time window is automatically determined, based on the time-based moving window of pixel counts of the current time window. The method automatically determines if the marking material usage for the current time window exceeds a threshold. A notification is automatically output if the marking material usage for the current time window exceeds the threshold.

20 Claims, 3 Drawing Sheets

DETERMINING HIGH TONER USAGE

BACKGROUND

Systems and methods herein generally relate to machines such as printer and/or copier devices and, more particularly, to methods to determine toner usage in such machines.

In an image forming apparatus, toner usage may be determined by calculating area coverage, using a set number of images, and predicting the image throughput, while taking into account the image size. Such techniques usually need to know the size of the images in order to calculate the area coverage. However, if the instantaneous rate of toner usage is greater than the maximum replenishment rate, then the image forming apparatus would have to take some action in order to prevent running out of toner; otherwise, the image would eventually become too light and further on could damage the printer.

SUMMARY

Disclosed herein is a fast and efficient method for determining a dynamic, moving time window in which is accumulated the overall number of pixels marked by an image marking device. Therefore, the methods herein provide an approximation for the instantaneous toner usage by the image marking device. Devices and methods herein can be used to detect a period of high toner usage and determine out of control scenarios (i.e. if the toner usage is greater than the maximum toner dispense rate for the image marking device) by comparing against a threshold of known maximum toner delivery rates.

According to a method herein, a queue of image descriptors is automatically formed using a computerized device. Each image descriptor in the queue comprises a number of pixels marked on an image and a time of marking the image by an image marking device. The queue comprises the image descriptors recorded over a selected time window. Responsive to a new image descriptor being added to the queue, the new image descriptor having a new time mark, a queue window is automatically determined, using the computerized device, based on the new time mark and the selected time window. A total number of pixels marked on images for all image descriptors in the queue window is automatically calculated, using the computerized device. Toner usage in the queue window is automatically determined, using the computerized device, based on the total number of pixels.

According to another method herein, a number of pixels marked and times of printing are automatically determined for a plurality of images, using a computerized device. A time-based moving window of pixel counts for a subset of the plurality of images being contiguously processed in a current time window is automatically calculated, using the computerized device, based on the number of pixels marked and the times of printing of the subset of the plurality of images processed in the current time window. Marking material usage to print the plurality of images for the current time window is automatically determined, using the computerized device, based on the time-based moving window of pixel counts of the current time window. The computerized device automatically determines if the marking material usage for the current time window exceeds a threshold. A notification is automatically output from the computerized device if the marking material usage for the current time window exceeds the threshold.

According to a printing device herein, the printing device comprises a processor, a printing engine operatively connected to the processor, and a marking material dispenser operatively connected to the printing engine. The processor detects a number of pixels from the marking material dispenser marked on an image by the printing engine. The processor records a time of marking the image. The processor forms a time-ordered queue of image descriptors over a selected period of time. Each image descriptor in the time-ordered queue comprises a number of pixels from the marking material dispenser marked on the image and a time of marking the image. Responsive to a new image descriptor being added to the queue, the new image descriptor having a new time mark, the processor automatically determines a queue window based on the new time mark and the selected period of time. The processor removes from the queue any image descriptors falling outside the queue window. The processor automatically calculates a total number of pixels from the marking material dispenser marked on images for all image descriptors in the queue window. The processor automatically determines marking material usage in the queue window based on the total number of pixels.

These and other features are described in, or are apparent from, the following detailed description.

BRIEF DESCRIPTION OF THE DRAWINGS

Various examples of the devices and methods are described in detail below, with reference to the attached drawing figures, which are not necessarily drawn to scale and in which.

DETAILED DESCRIPTION

Figure 1:
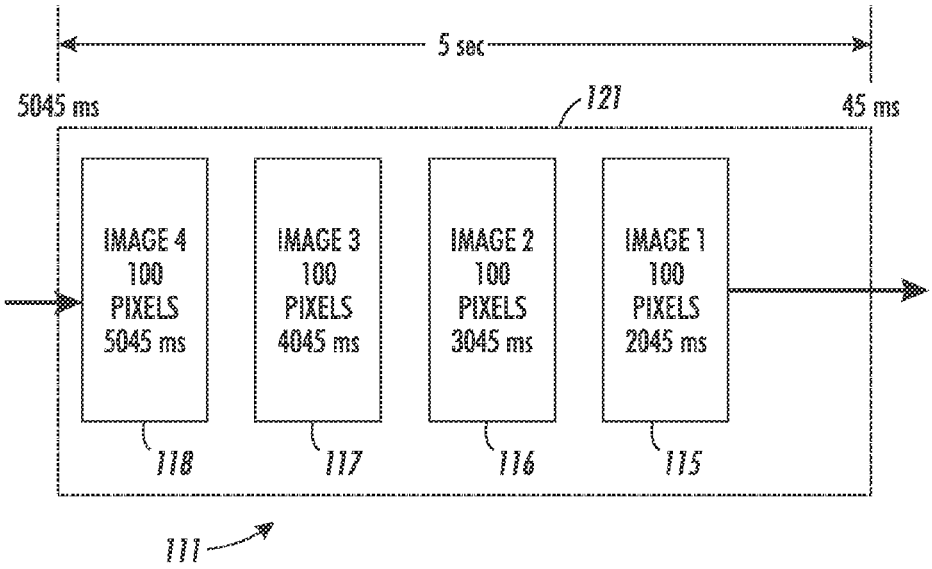
FIG. 1 is a block diagram illustrating devices and methods herein.

The disclosure will now be described by reference to a printing apparatus that includes a device and method for determining marking material usage. While the disclosure will be described hereinafter in connection with specific devices and methods thereof, it will be understood that limiting the disclosure to such specific devices and methods is not intended. On the contrary, it is intended to cover all alternatives, modifications, and equivalents as may be included within the spirit and scope of the disclosure as defined by the appended claims. The following algorithm does not use a set number of images or their size but keeps a time based moving window of pixel counts.

For a general understanding of the features of the disclosure, reference is made to the drawings. In the drawings, like reference numerals have been used throughout to identify identical elements.

According to devices and methods herein, a number of pixels marked and times of marking the pixels are automatically determined for a plurality of images. A time-based moving window of pixel counts for a subset of the images being contiguously processed in the current time window is automatically calculated, based on the number of pixels marked and the times of marking of the subset of the images processed in the current time window. The marking material usage to print the images for the current time window is automatically determined, based on the time-based moving window of pixel counts of the current time window. It may be determined whether the marking material usage for the current time window exceeds a threshold. A notification is output if the marking material usage for the current time window exceeds the threshold.

As is known in the art, a "pixel" refers to the smallest segment into which an image can be divided. Received pixels of an input image are associated with a color value defined in terms of a color space, such as color, intensity, lightness, brightness, or some mathematical transformation thereof. Pixel color values may be converted to a chrominance-luminance space using, for instance, an RBG-to-YCbCr converter to obtain luminance (Y) and chrominance (Cb, Cr) values. It should be appreciated that pixels may be represented by values other than RGB or YCbCr.

Further, an image output device is any device capable of rendering the image. The set of image output devices includes digital document reproduction equipment and other copier systems as are widely known in commerce, photographic production and reproduction equipment, monitors and other displays, computer workstations and servers, including a wide variety of color marking devices, and the like.

To render an image is to reduce the image data (or a signal thereof) to viewable form; store the image data to memory or a storage device for subsequent retrieval; or communicate the image data to another device. Such communication may take the form of transmitting a digital signal of the image data over a network.

FIG. 1 shows a queue of image descriptors, indicated generally as 111. The queue 111 contains image descriptors 115-118 for images 1-4, in a time window 121. Each image descriptor 115-118 identifies the number of pixels in its associated image and the time at which the image was marked. In the specific example shown in FIG. 1, the time window 121 has a range of five seconds. Other window sizes can be used. According to devices and methods herein, the width of the time window 121 can be selected. In this non-limiting example, the 5-second time window extends from 5045 milliseconds to 45 milliseconds.

There are four image descriptors 115, 116, 117, and 118 in the queue 111. Each image descriptor 115-118 is associated with one of Images 1-4, respectively. In the example shown in FIG. 1, the image descriptor 115-118 show that one image is marked every second (1000 ms) and each of the images contains 100 pixels. That is, Image 1 is marked at 2045 ms and has 100 pixels; Image 2 is marked at 3045 ms and has 100 pixels; Image 3 is marked at 4045 ms and has 100 pixels; and Image 4 is marked at 5045 ms and has 100 pixels. This obtains an accumulated pixel count of 400 pixels for all the image descriptors in the queue 111.

When a new image (Image 5) is marked, a new image descriptor 125 containing the time marked and the pixel count for the new image is recorded and added to the front of the queue 111. The time window 121 is recalculated from the time mark of the new image. The range of the time window 121 remains the same (i.e. 5 seconds), but now extends from 7200 milliseconds to 2200 milliseconds. Any old image(s) marked before the new range of the time window 121 is removed from the queue. A new accumulated pixel count is then calculated.

Figure 2:
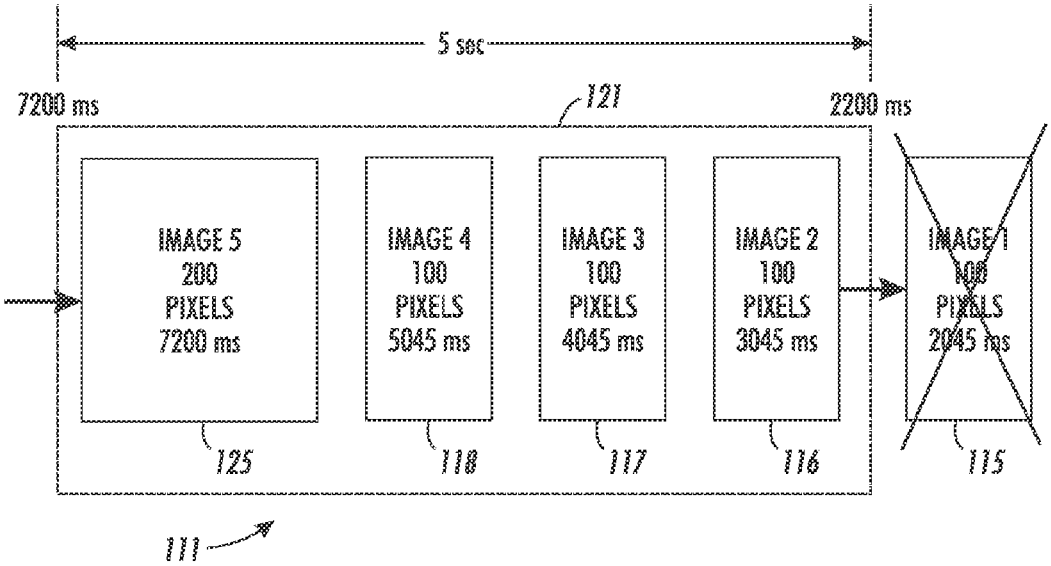
FIG. 2 is a block diagram illustrating devices and methods herein

For example, referring to FIG. 2, when the new image (Image 5), which is marked at 7200 ms, is added to the queue 111 the 5-second time window changes (7200 milliseconds to 2200 milliseconds); therefore, Image 1 is too old (2045 ms) and is removed from the queue 111. There are still four image descriptors 116, 117, 118, and 125 in the queue 111. Note: Image 5 is a larger image (200 pixels); therefore, the accumulated pixel count is now 500 pixels in the time window 121.

According to devices and methods herein, the above accumulated pixel count is calculated only when a new image is added to the queue. That is, the disclosed method maintains a dynamic moving time window in which the overall number of pixels marked is accumulated. This is very efficient in order to provide a simple and quick approximation of toner or marking material usage, providing an indication of near-real time pixel demand.

The method provides an approximation for instantaneous toner usage; however, using the image descriptor information, the accumulated pixel count for the same time window can be calculated by summing the images from any point in time desired. For example, referring again to FIG. 2, if there are no more images received in the next 2 seconds, image descriptors recorded between 9200 ms and 4200 ms can be summed, resulting in an instantaneous accumulated pixel count of 300, as Image 2 and Image 3 are now too old.

According to devices and methods herein, the disclosed method can be used to determine if the instantaneous marking material usage rate is greater than the maximum replenishment rate. The accumulated pixel count over the selected time window 121 is directly proportional to the recent toner usage. In other words, the disclosed method uses the "Pixel count and time marked" of each image and produces an estimation of "Instantaneous Area Coverage in pixels/sec" and therefore toner usage. As such, the accumulated pixel count can be used predictively to determine whether the associated imaging device is experiencing a high instantaneous toner demand for simple comparison against a known, predetermined threshold for the marking material delivery rate. For example, in the specific example shown in FIG. 2, the threshold may be 550 pixels in any 5-second interval, which would mean that when Image 5 is marked, the threshold is exceeded.

Note: a notification may be automatically output if the marking material usage for the current time window exceeds the threshold. Furthermore, the accuracy of the usage calculation can be tuned in a variety of ways, such as by selecting an appropriate time window for the given process speed and/or by choosing to use an accumulated usage updated whenever a new image is marked or calculating the accumulated value when it is used.

Figure 3:
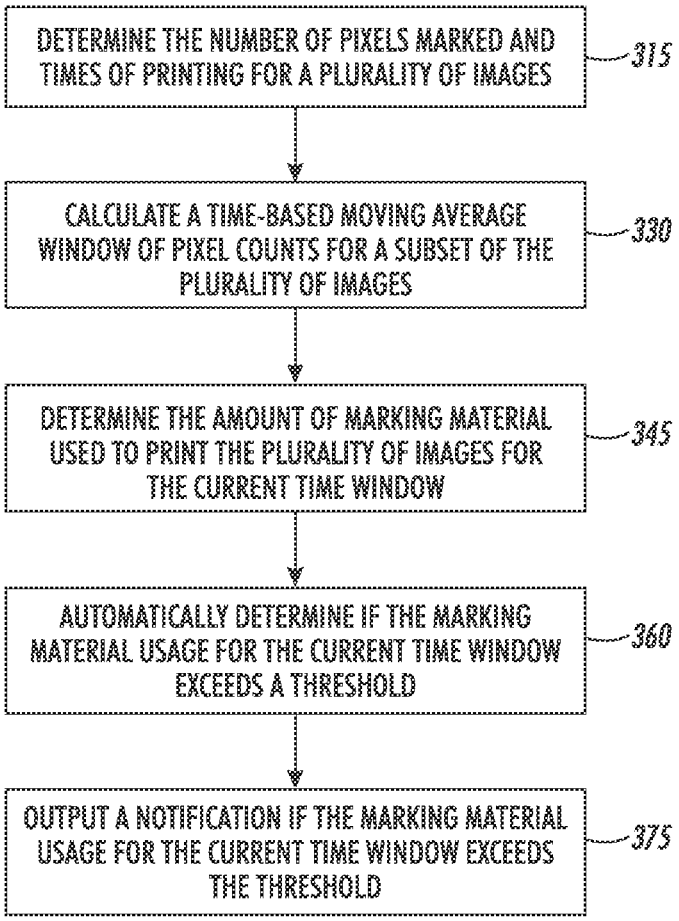
FIG. 3 is a flow diagram illustrating methods herein.

FIG. 3 is a flow diagram illustrating the processing flow of an exemplary method according to devices and methods herein. At 315, a number of pixels marked and times of printing are automatically determined for a plurality of images. At 330, a time-based, moving window of pixel counts for a subset of the plurality of images being contiguously processed in a current time window is automatically calculated. The time-based, moving window of pixel counts is based on the number of pixels marked and the times of printing of the subset of the plurality of images processed in the current time window. The amount of marking material used to print the plurality of images for the current time window is automatically determined, at 345. The amount of marking material is based on the time-based moving window of pixel counts of the current time window. Using a computerized device, automatically determine if the marking material usage for the current time window exceeds a threshold, at 360. At 375, a notification is automatically output from the computerized device if the marking material usage for the current time window exceeds the threshold.

Figure 4:
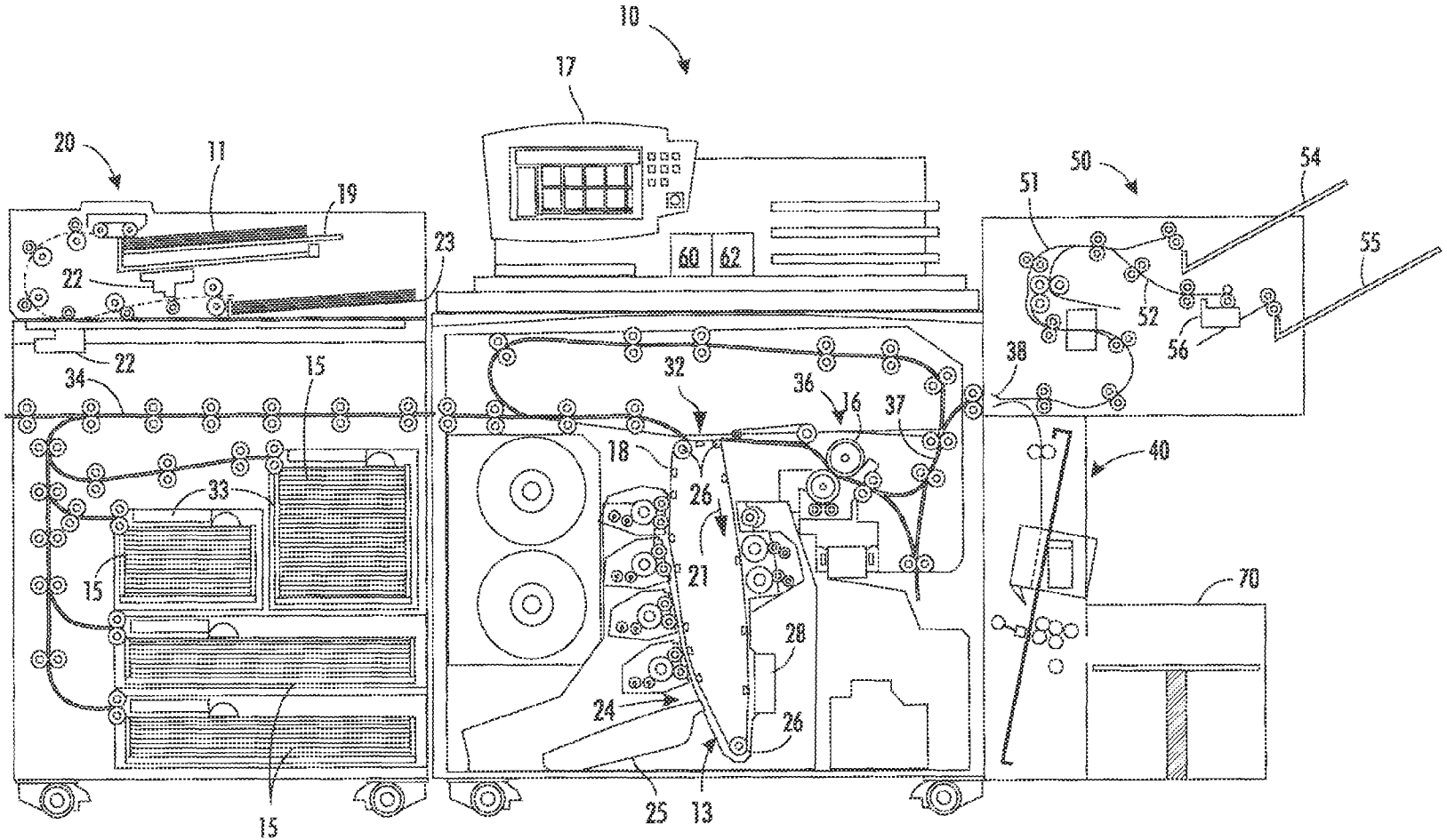
FIG. 4 is a schematic diagram illustrating devices and methods herein.

Referring to the FIG. 4 a printing device 10 is shown which can be used with devices and methods herein and can comprise, for example, a printer, copier, multi-function machine, multi-function device (MFD), etc. The printing device 10 includes an automatic document feeder 20 (ADF) that can be used to scan (at a scanning station 22) original documents 11 fed from a first tray 19 to a second tray 23. The user may enter the desired printing and finishing instructions through the graphic user interface (GUI) or control panel 17, or use a job ticket, an electronic print job description from a remote source, etc. The GUI or control panel 17 can include one or more processors 60, power supplies, as well as storage devices 62 storing programs of instructions that are readable by the processors 60 for performing the various functions described herein. The storage devices 62 can comprise, for example, non-volatile storage mediums including magnetic devices, optical devices, capacitor-based devices, etc.

An electronic or optical image or an image of an original document or set of documents to be reproduced may be projected or scanned onto a charged surface 13 or a photoreceptor belt 18 to form an electrostatic latent image. The photoreceptor belt 18 is mounted on a set of rollers 26. At least one of the rollers 26 is driven to move the photoreceptor belt 18 in the direction indicated by arrow 21 past the various other known electrostatic processing stations, including a charging station 28, imaging station 24 (for a raster scan laser system 25), developing station 30, and transfer station 32.

Thus, the latent image is developed with developing material to form a toner image corresponding to the latent image. More specifically, a sheet of print media 15 is fed from a selected media sheet tray 33 having a supply of paper to a sheet transport 34 for travel to the transfer station 32. There, the toned image is electrostatically transferred to the print media 15, to which it may be permanently fixed by a fusing device 16. The sheet is stripped from the photoreceptor belt 18 and conveyed to a fusing station 36 having fusing device 16 where the toner image is fused to the sheet. A guide can be applied to the print media 15 to lead it away from the fuser roll. After separating from the fuser roll, the print media 15 is then transported by a sheet output transport 37 to output trays in a multi-functional finishing station 50.

Printed sheets from the printing device 10 can be accepted at an entry port 38 and directed to multiple paths and output trays for printed sheets, top tray 54 and main tray 55, corresponding to different desired actions, such as stapling, hole-punching and C or Z-folding. The multi-functional finishing station 50 can also optionally include, for example, a modular booklet maker 40 although those ordinarily skilled in the art would understand that the multi-functional finishing station 50 could comprise any functional unit, and that the modular booklet maker 40 is merely shown as one example. The finished booklets are collected in a stacker 70. It is to be understood that various rollers and other devices that contact and handle sheets within the multi-functional finishing station 50 are driven by various motors, solenoids, and other electromechanical devices (not shown), under a control system, such as including the processor 60 of the GUI or control panel 17 or elsewhere, in a manner generally familiar in the art. The processor 60 may comprise a microprocessor.

Thus, the multi-functional finishing station 50 has a top tray 54 and a main tray 55 and a folding and booklet making station that adds stapled and unstapled booklet making, and single sheet C-fold and Z-fold capabilities. The top tray 54 is used as a purge destination, as well as, a destination for the simplest of jobs that require no finishing and no collated stacking. The main tray 55 can have, for example, a pair of pass-through staplers 56, and is used for most jobs that require stacking or stapling. The folding destination is used to produce signature booklets, saddle stitched or not, and tri-folded. The finished booklets are collected in the stacker 70. Sheets that are not to be C-folded, Z-folded, or made into booklets or that do not require stapling are forwarded along path 51 to the top tray 54. Sheets that require stapling are forwarded along path 52, stapled with staplers 56, and deposited into the main tray 55.

As would be understood by those ordinarily skilled in the art, the printing device 10 shown in FIG. 4 is only one example and the devices and methods herein are equally applicable to other types of printing devices that may include fewer components or more components. For example, while a limited number of printing engines and paper paths are illustrated in FIG. 4, those ordinarily skilled in the art would understand that many more paper paths and additional printing engines could be included within any printing device used with devices and methods herein.

Thus, an image input device is any device capable of obtaining color pixel values from a color image. The set of image input devices is intended to encompass a wide variety of devices such as, for example, digital document devices, computer systems, memory and storage devices, networked platforms such as servers and client devices which can obtain pixel values from a source device, and image capture devices. The set of image capture devices includes scanners, cameras, photography equipment, facsimile machines, photo reproduction equipment, digital printing presses, xerographic devices, and the like. A scanner is one image capture device that optically scans images, print media, and the like, and converts the scanned image into a digitized format. Common scanning devices include variations of the flatbed scanner, generally known in the arts, wherein specialized image receptors move beneath a platen and scan the media placed on the platen. Modern digital scanners typically incorporate a charge-coupled device (CCD) or a contact image sensor (CIS) as the image sensing receptor(s). The scanning device produces a signal of the scanned image data. Such a digital signal contains information about pixels such as color value, intensity, and their location within the scanned image.

It is contemplated that the systems and methods described herein are applicable to color marking material as well as simple black marking material. A contone is a characteristic of a color image such that the image has all the values (0 to 100%) of gray (black/white) or color in it. A contone can be approximated by millions of gradations of black/white or color values. The granularity of computer screens (i.e., pixel size) can limit the ability to display absolute contones. The term halftoning means a process of representing a contone image by a bi-level image such that, when viewed from a suitable distance, the bi-level image gives the same impression as the contone image. Halftoning reduces the number of quantization levels per pixel in a digital image. Over the long history of halftoning, a number of halftoning techniques have been developed which are adapted for different applications.

Traditional clustered dot halftones were restricted to a single frequency because they were generated using periodic gratings that could not be readily varied spatially. Halftoning techniques are widely employed in the printing and display of digital images and are used because the physical processes involved are binary in nature or because the processes being used have been restricted to binary operation for reasons of cost, speed, memory, or stability in the presence of process fluctuations. Classical halftone screening applies a mask of threshold values to each color of the multi-bit image. Thresholds are stored as a matrix in a repetitive pattern. Each tile of the repetitive pattern of the matrix is a halftone cell. Digital halftones generated using threshold arrays that tile the image plane were originally designed to be periodic for simplicity and to minimize memory requirements. With the increase in computational power and memory, these constraints become less stringent. Digital halftoning uses a raster image or bitmap within which each monochrome picture element or pixel may be ON or OFF (ink or no ink). Consequently, to emulate the photographic halftone cell, the digital halftone cell must contain groups of monochrome pixels within the same-sized cell area.

Aspects of the present disclosure are described herein with reference to flowchart illustrations and/or block diagrams of methods, apparatus (systems), and computer program products according to various devices and methods. It will be understood that each block of the flowchart illustrations and/or two-dimensional block diagrams, and combinations of blocks in the flowchart illustrations and/or block diagrams, can be implemented by computer program instructions. The computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

According to a further device and method herein, an article of manufacture is provided that includes a tangible computer readable medium having computer readable instructions embodied therein for performing the steps of the computer implemented methods, including, but not limited to, the method illustrated in FIG. 3. Any combination of one or more computer readable non-transitory medium(s) may be utilized. The computer readable medium may be a computer readable signal medium or a computer readable storage medium. The non-transitory computer storage medium stores instructions, and a processor executes the instructions to perform the methods described herein. A computer readable storage medium may be, for example, but not limited to, an electronic, magnetic, optical, electromagnetic, infrared, or semiconductor system, apparatus, or device, or any suitable combination of the foregoing. Any of these devices may have computer readable instructions for carrying out the steps of the methods described above with reference to FIG. 3.

The computer program instructions may be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

Furthermore, the computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

In case of implementing the devices and methods herein by software and/or firmware, a program constituting the software may be installed into a computer with dedicated hardware, from a storage medium or a network, and the computer is capable of performing various functions if with various programs installed therein.

In the case where the above-described series of processing is implemented with software, the program that constitutes the software may be installed from a network such as the Internet or a storage medium such as the removable medium. Examples of a removable medium include a magnetic disk (including a floppy disk), an optical disk (including a Compact Disk-Read Only Memory (CD-ROM) and a Digital Versatile Disk (DVD)), a magneto-optical disk (including a Mini-Disk (MD) (registered trademark)), and a semiconductor memory. Alternatively, the storage medium may be the ROM, a hard disk contained in the storage section of the disk units, or the like, which has the program stored therein and is distributed to the user together with the device that contains them.

As will be appreciated by one skilled in the art, aspects of the devices and methods herein may be embodied as a system, method, or computer program product. Accordingly, aspects of the present disclosure may take the form of an entirely hardware system, an entirely software system (including firmware, resident software, micro-code, etc.) or an system combining software and hardware aspects that may all generally be referred to herein as a "circuit," "module", or "system." Furthermore, aspects of the present disclosure may take the form of a computer program product embodied in one or more computer readable medium(s) having computer readable program code embodied thereon.

Any combination of one or more computer readable non-transitory medium(s) may be utilized. The computer readable medium may be a computer readable signal medium or a computer readable storage medium. The non-transitory computer storage medium stores instructions, and a processor executes the instructions to perform the methods described herein. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium include the following: an electrical connection having one or more wires, a portable computer diskette, a hard disk, a random access memory (RAM), a Read Only Memory (ROM), an Erasable Programmable Read Only Memory (EPROM or Flash memory), an optical fiber, a magnetic storage device, a portable compact disc Read Only Memory (CD-ROM), an optical storage device, a "plug-and-play" memory device, like a USB flash drive, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electro-magnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including, but not limited to, wireless, wireline, optical fiber cable, RF, etc., or any suitable combination of the foregoing.

Computer program code for carrying out operations for aspects of the present disclosure may be written in any combination of one or more programming languages, including an object oriented programming language such as Java, Smalltalk, C++, or the like and conventional procedural programming languages, such as the "C" programming language or similar programming languages. The program code may execute entirely on the user's computer, partly on the user's computer, as a stand-alone software package, partly on the user's computer and partly on a remote computer, or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

The flowchart and block diagrams in the figures illustrate the architecture, functionality, and operation of possible implementations of systems, methods, and computer program products according to various devices and methods herein. In this regard, each block in the flowchart or block diagrams may represent a module, segment, or portion of code, which comprises one or more executable instructions for implementing the specified logical function(s). It should also be noted that, in some alternative implementations, the functions noted in the block might occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

Many computerized devices are discussed above. Computerized devices that include chip-based central processing units (CPU's), input/output devices (including graphic user interfaces (GUI), memories, comparators, processors, etc. are well-known and readily available devices produced by manufacturers such as Dell Computers, Round Rock Tex., USA and Apple Computer Co., Cupertino Calif., USA. Such computerized devices commonly include input/output devices, power supplies, processors, electronic storage memories, wiring, etc., the details of which are omitted herefrom to allow the reader to focus on the salient aspects of the embodiments described herein. Similarly, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known and are not described in detail herein to keep this disclosure focused on the salient features presented. The systems and methods herein can encompass systems and methods that print in color, monochrome, or handle color or monochrome image data. All foregoing systems and methods are specifically applicable to electrostatographic and/or xerographic machines and/or processes.

The terminology used herein is for the purpose of describing particular devices and methods only and is not intended to be limiting of this disclosure. As used herein, the singular forms "a", "an", and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

In addition, terms such as "right", "left", "vertical", "horizontal", "top", "bottom", "upper", "lower", "under", "below", "underlying", "over", "overlying", "parallel", "perpendicular", etc., used herein, are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Further, the terms 'automated' or 'automatically' mean that once a process is started (by a machine or a user), one or more machines perform the process without further input from any user.

The corresponding structures, materials, acts, and equivalents of all means or step plus function elements in the claims below are intended to include any structure, material, or act for performing the function in combination with other claimed elements as specifically claimed. The descriptions of the various devices and methods of the present disclosure have been presented for purposes of illustration, but are not intended to be exhaustive or limited to the devices and methods disclosed. Many modifications and variations will be apparent to those of ordinary skill in the art without departing from the scope and spirit of the described devices and methods. The terminology used herein was chosen to best explain the principles of the devices and methods, the practical application or technical improvement over technologies found in the marketplace, or to enable others of ordinary skill in the art to understand the devices and methods disclosed herein.

It will be appreciated that the above-disclosed and other features and functions, or alternatives thereof, may be desirably combined into many other different systems or applications. Those skilled in the art may subsequently make various presently unforeseen or unanticipated alternatives, modifications, variations, or improvements therein, which are also intended to be encompassed by the following claims. Unless specifically defined in a specific claim itself, steps or components of the devices and methods herein should not be implied or imported from any above example as limitations to any particular order, number, position, size, shape, angle, color, temperature, or material.

What is claimed is:

1. A method comprising:

automatically forming a queue of image descriptors, using a computerized device, each image descriptor in said queue comprising a number of pixels marked on an image and a time of marking said image using an image marking device, said queue comprising said image descriptors recorded over a selected time window;

responsive to a new image descriptor being added to said queue, said new image descriptor having a new time mark:

automatically determining a queue window based on said new time mark and said selected time window, using said computerized device, removing from said queue any image descriptors falling outside said queue window, and automatically calculating a total number of pixels marked on images for all image descriptors in said queue window, using said computerized device; and automatically determining toner usage in said queue window based on said total number of pixels, using said computerized device.

2. The method according to claim 1, further comprising:

comparing said toner usage to a maximum toner dispense rate for said image marking device, using said computerized device.

3. The method according to claim 1, further comprising:
automatically determining if said toner usage exceeds a predetermined threshold, using said computerized device.

4. The method according to claim 3, further comprising:
responsive to said toner usage exceeding said predetermined threshold, outputting a notification, using said computerized device.

5. The method according to claim 1, further comprising:
automatically determining instantaneous toner usage over a selected time window, using said computerized device.

6. The method according to claim 1, further comprising:
selecting said time window based on a process speed of said image marking device, using said computerized device.

7. The method according to claim 1, further comprising:
automatically determining toner usage to print a plurality of images for said queue window based on a time-based moving window of pixel counts of said queue window, using said computerized device.

8. A method, comprising:
automatically determining a number of pixels marked by an image marking device and times of printing for a plurality of images, using a computerized device;
automatically calculating a time-based moving window of pixel counts for a subset of said plurality of images being contiguously processed in a current time window based on said number of pixels marked and said times of printing of said subset of said plurality of images processed in said current time window, using said computerized device;
automatically determining marking material usage to print said plurality of images using said image marking device for said current time window based on said time-based moving window of pixel counts of said current time window, using said computerized device; and
automatically determining if the rate of marking material usage for said current time window exceeds a maximum dispense rate for said image marking device, using said computerized device.

9. The method according to claim 8, further comprising:
comparing said marking material usage to said maximum dispense rate for said image marking device, using said computerized device.

10. The method according to claim 8, further comprising:
automatically determining if said marking material usage for said current time window exceeds a threshold, using said computerized device.

11. The method according to claim 10, further comprising:
automatically outputting a notification, from said computerized device, if said marking material usage for said current time window exceeds said threshold.

12. The method according to claim 8, further comprising:
automatically determining instantaneous marking material usage over a selected time window, using said computerized device.

13. The method according to claim 8, further comprising:
selecting a time window based on a process speed of said image marking device, using said computerized device.

14. A printing device comprising:
a processor;
a printing engine operatively connected to said processor; and
a marking material dispenser; operatively connected to said printing engine,
said processor detecting a number of pixels from said marking material dispenser marked on an image by said printing engine,
said processor recording a time of marking said image,
said processor forming a time-ordered queue of image descriptors over a selected period of time, each image descriptor in said time-ordered queue comprising a number of pixels from said marking material dispenser marked on said image and a time of marking said image; and
responsive to a new image descriptor being added to said queue, said new image descriptor having a new time mark:
said processor automatically determining a queue window based on said new time mark and said selected period of time,
said processor removing from said queue any image descriptors falling outside said queue window,
said processor automatically calculating a total number of pixels from said marking material dispenser marked on images for all image descriptors in said queue window, and
said processor automatically determining marking material usage in said queue window based on said total number of pixels.

15. The printing device according to claim 14, further comprising:
said processor comparing said marking material usage to a maximum dispense rate for said marking material dispenser.

16. The printing device according to claim 14, further comprising:
said processor automatically determining if said marking material usage for said queue window exceeds a threshold.

17. The printing device according to claim 16, further comprising:
said processor automatically outputting a notification if said marking material usage for said queue window exceeds said threshold.

18. The printing device according to claim 14, further comprising:
said processor automatically determining instantaneous marking material usage over a selected time window.

19. The printing device according to claim 14, further comprising:
said processor automatically selecting a time window based on a process speed of said image marking device.

20. The printing device according to claim 14, further comprising:
said processor automatically determining marking material usage to print a plurality of images by said print engine for said queue window based on a time-based moving window of pixel counts of said queue window.

* * * * *